US006626559B1

(12) United States Patent
Lin

(10) Patent No.: US 6,626,559 B1
(45) Date of Patent: Sep. 30, 2003

(54) DECORATIVE LIGHT

(76) Inventor: Kang-Tien Lin, No. 47, Lane 80, Wen-Ya St., Hsinchu City (TW)

( * ) Notice: Subject to any disclaimer, the term of this patent is extended or adjusted under 35 U.S.C. 154(b) by 0 days.

(21) Appl. No.: 10/287,548

(22) Filed: Nov. 5, 2002

(51) Int. Cl.[7] ..... F21V 33/00

(52) U.S. Cl. ..... 362/249; 362/123; 362/124; 362/223; 362/217; 362/352; 362/806; 362/808

(58) Field of Search ..... 362/101, 123, 362/124, 808, 252, 567, 568, 249, 352, 806, 217, 222, 223

(56) References Cited

U.S. PATENT DOCUMENTS 4,179,832 A * 12/1979 Lemelson ..... 40/540
5,102,131 A * 4/1992 Remington et al. ..... 273/58 G
5,609,411 A * 3/1997 Wang ..... 362/234
6,276,815 B1 * 8/2001 Wu ..... 362/234
6,431,729 B1 * 8/2002 Chen ..... 362/249

* cited by examiner

*Primary Examiner*—Laura K. Tso
(74) *Attorney, Agent, or Firm*—Bacon & Thomas PLLC

(57) ABSTRACT

A decorative light has an inflatable body, and a foldable tube light mounted inside the body. The tube light is connected to and extends between a base and a top cap that are mounted inside the body. The decorative light includes an inflatable plastic membrane, and an inflation opening with a stopper is defined in the body. A hook is mounted on the body to suspend the decorative light in place. When the decorative light is large, the tube light may extend through an eyehook inside the body and attach to the base and the top, with each being mounted inside the same end of the body.

7 Claims, 4 Drawing Sheets

DECORATIVE LIGHT

BACKGROUND OF THE INVENTION

1. Field of Invention

The present invention relates to a decorative light, and more particularly to a decorative light that can be packed and stored easily.

2. Description of the Related Art

On some special holidays such as Christmas, people like to use beautiful lights to decorate houses, churches and streets. Most commonly used decorative lights have a decorative ornament and a bulb inside the decorative ornament. The fixed sizes and shapes of the decorative ornaments make packing and storing the decorative lights difficult. Furthermore, the bulbs of decorative lights are often mounted inside only one end of the decorative ornaments causing light to be unevenly distributed. Other ways to mount the bulbs on the decorative ornaments are also complex and expensive.

To overcome these shortcomings, decorative lights that can be packed simply and easily stored are still needed, and a decorative light in accordance with the present invention obviates or mitigates the aforementioned problems.

SUMMARY OF THE INVENTION

The primary objective of the present invention is to provide a decorative light that utilizes an inflatable plastic membrane to replace the decorative ornament of fixed size and shape and a foldable tube light to replace a rigid bulb. With such features, the decorative lights are foldable, and the volume of the decorative lights is changeable. Therefore, the decorative lights can be packed and stored easily.

To achieve the objective, a decorative light in accordance with the present invention comprises an inflatable body, a base, a top cap and a flexible tube light. The inflatable body has two ends, an inflation opening with a stopper and a hook formed on the surface of the body. The base is mounted inside the inflatable body and on one end of the body and connected to a power source. The top cap is mounted inside the inflatable body and on the end opposite to the end with the cap. The tube light extends between the base and the top cap. The flexible tube light is foldable.

Other objectives, advantages and novel features of the invention will become more apparent from the following detailed description when taken in conjunction with the accompanying drawings.

DETAILED DESCRIPTION OF THE INVENTION

Figure 1:
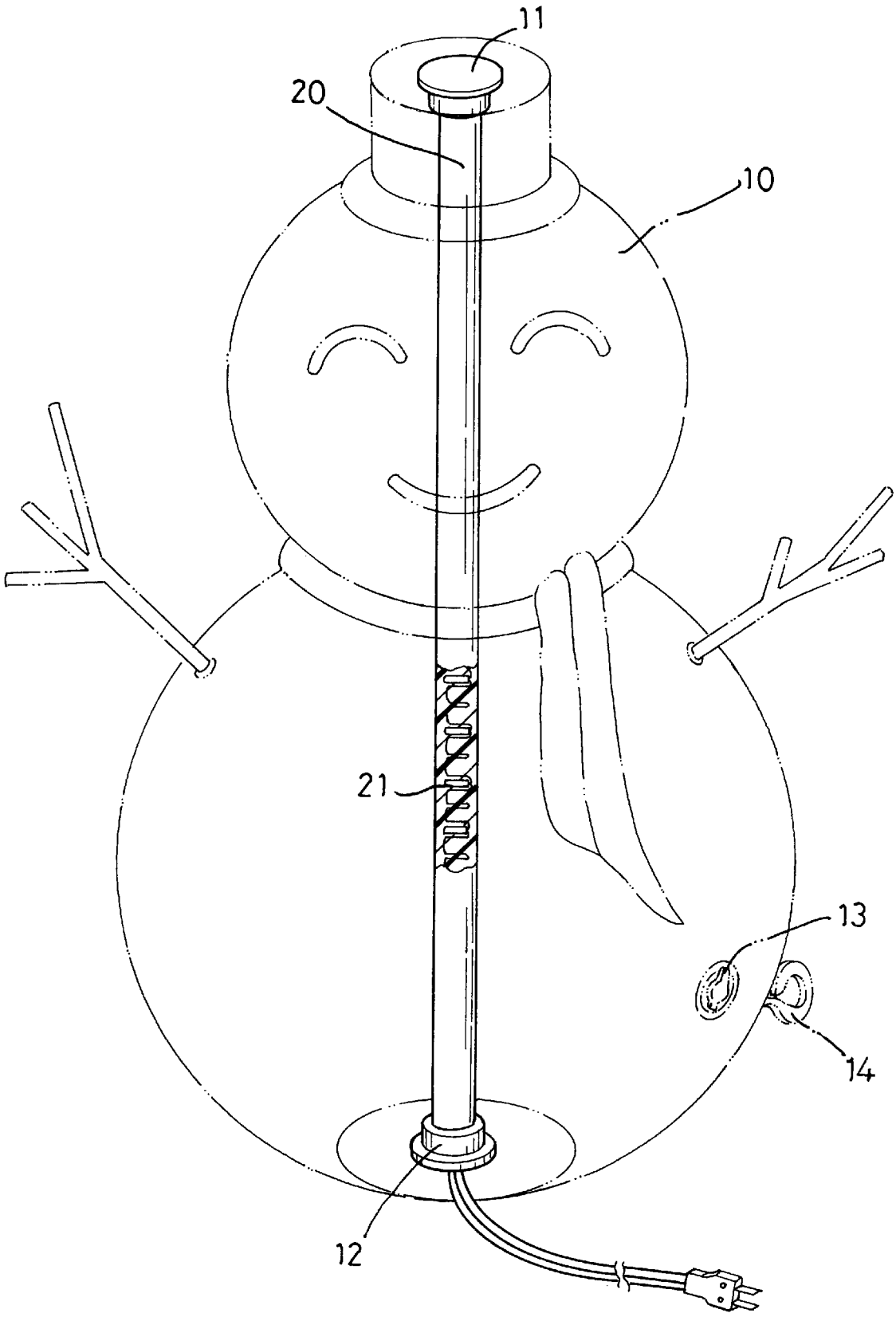
FIG. 1 is a perspective view of a first embodiment of a decorative light in accordance with the present invention.

With reference to FIG. 1, a decorative light in accordance with the present invention comprises an inflatable body (10), a base (12), a top cap (11) and a flexible tube light (20) mounted inside the body (10).

The body (10) is a PVC plastic membrane and has two ends, an inflation opening (13) with a stopper and a hook (14) formed on an outer surface of the body (10). The base (12) is securely mounted inside the body (10) and at one end of the body (10), and the top cap (11) is securely mounted inside the body (10) and at an end opposite to the end with the base (12). The base (12) is selectively connected to a power source. The inflation opening (13) is defined in the body (10), and the hook (14) is attached to or formed with the body (10).

The flexible tube light (20) is foldable, and at least one and preferably multiple luminous elements (21) are mounted inside the tube light (20).

Figure 2:
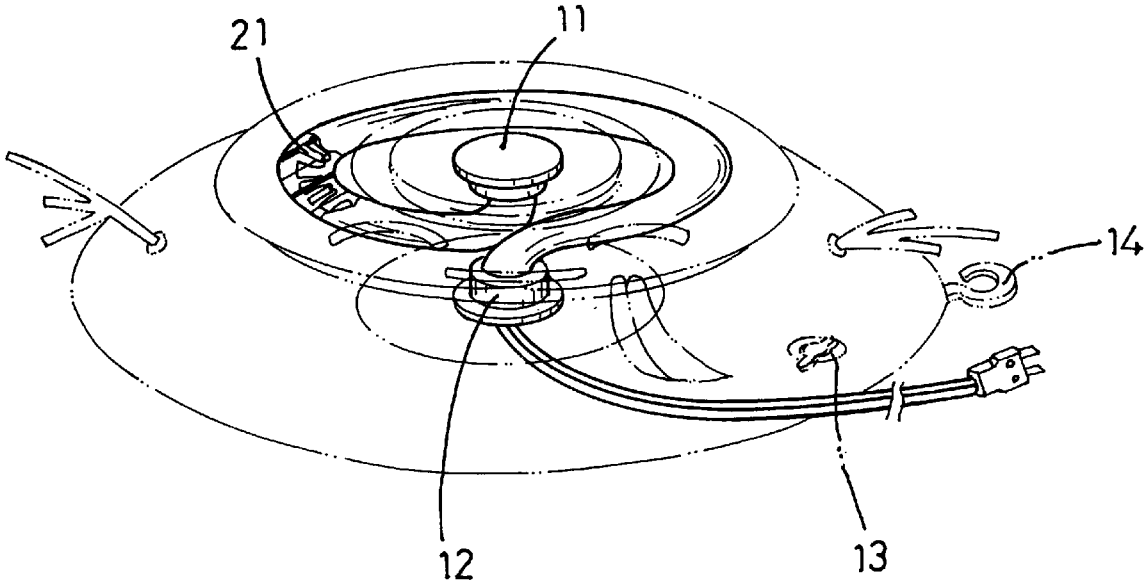
FIG. 2 is a perspective view of the decorative light in FIG. 1, shown collapsed for storage.

With reference to FIG. 2, the decorative light is collapsed by releasing air from within the inflatable body (10) via the inflation opening (13). Because the tube light (20) is collapsible, the total volume of the decorative light is decreased when the inflatable body (10) is empty of air. When the inflatable body (10) has been collapsed, it can be packed easily.

Figure 3:
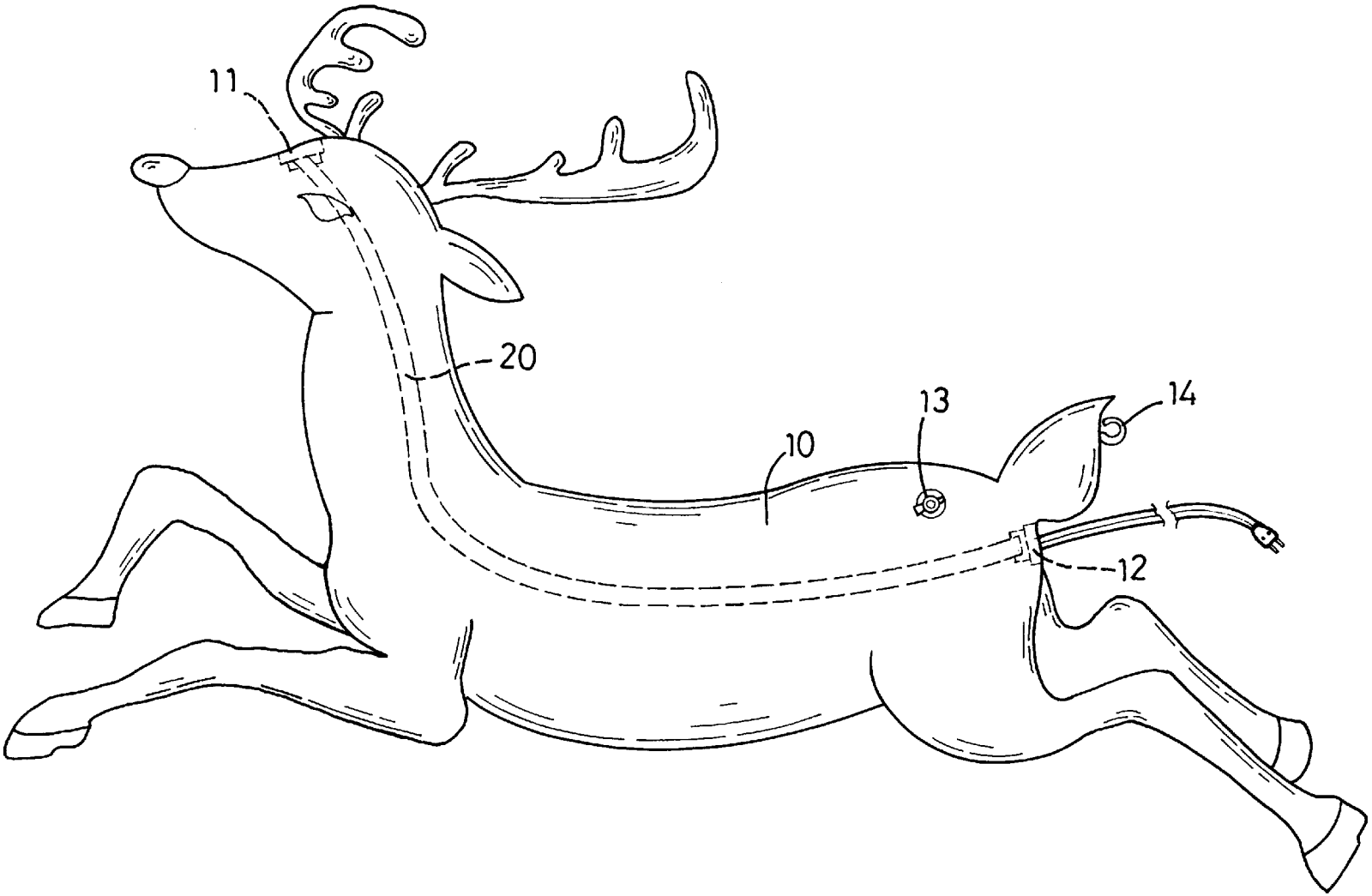
FIG. 3 is a plan view of a second embodiment of the decorative light in accordance with the invention.

With reference to FIG. 3, the decorative lights can be formed in many shapes, such as a deer. The tube light (20) is mounted inside the inflatable body (10), and the decorative light is bright when connected to a power supply. The hook (14) is used to suspend the decorative light.

Figure 4:
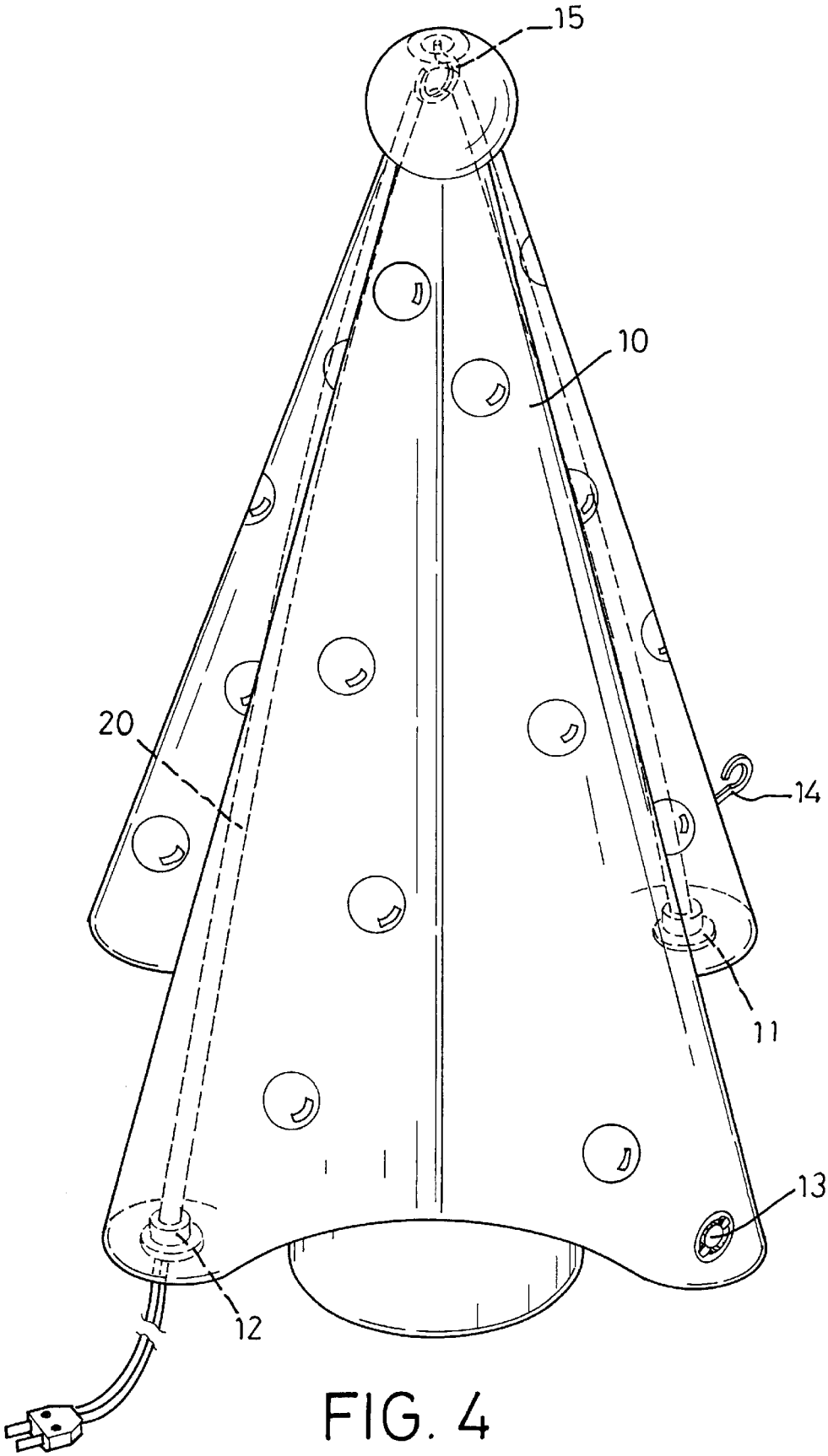
FIG. 4 is a perspective view of a third embodiment of the decorative light in accordance with the invention.

With reference to FIG. 4, when the decorative light is large, an eyehook (15) is mounted inside the body (10) to extend and guide the flexible tube light (20). The base (12) and the top cap (11) are mounted inside the body (10) and at an end opposite to the end where the eyehook (15) is secured. The tube light (20) extends through the eyehook (15) and has two ends respectively and detachably mounted on the base (12) and the top cap (11). With the arrangement of the eyehook, the tube light (20) is securely positioned so as to extend through the body (10), such that distribution of light from the tube light (20) is even and effective.

The invention may be varied in many ways by a person skilled in the art. Such variations are not to be regarded as a departure from the spirit and scope of the invention, and all such modifications are intended to be included within the scope of the following claims.

What is claimed is:

1. A decorative light comprising:

an inflatable body with two ends;

a base mounted inside one end of the inflatable body and selectively adapted to be connected to a power source;

a top cap mounted inside the inflatable body; and a flexible and foldable tube light mounted between the base and the top cap.

2. The decorative light as claimed in claim 1, wherein the top cap is mounted on the inflatable body at one end opposite to the base.

3. The decorative light as claimed in claim 1, wherein an inflation opening with a stopper is defined in the body.

4. The decorative light as claimed in claim 1, wherein a hook is mounted on the inflatable body.

5. The decorative light as claimed in claim 1 further comprising an eyehook mounted inside the inflatable body, wherein the base and the top cap are mounted inside the inflatable body away from the eyehook.

6. A decorative light comprising:

an inflatable body with two ends and a hook mounted on the inflatable body;

a base mounted inside one end of the inflatable body and selectively adapted to be connected to a power source;

a top cap mounted inside the inflatable body; and a flexible tube light mounted between the base and the top cap.

7. A decorative light comprising:

an inflatable body with two ends and an eyehook mounted inside the inflatable body;

a base mounted inside one end of the inflatable body and selectively adapted to be connected to a power source;

a top cap mounted inside the inflatable body; and a flexible tube light mounted between the base and the top cap.

* * * * *